US008424139B2

(12) United States Patent
Wang

(10) Patent No.: US 8,424,139 B2
(45) Date of Patent: Apr. 23, 2013

(54) CHAIN LINK REMOVER FOR BICYCLE

(75) Inventor: Lo Pin Wang, Taichung (TW)

(73) Assignee: Beto Engineering & Marketing Co., Ltd., Beitun, Taichung (TW)

( * ) Notice: Subject to any disclaimer, the term of this patent is extended or adjusted under 35 U.S.C. 154(b) by 118 days.

(21) Appl. No.: 13/066,073

(22) Filed: Apr. 6, 2011

(65) Prior Publication Data

US 2012/0255273 A1 Oct. 11, 2012

(51) Int. Cl.
*B25B 13/00* (2006.01)

(52) U.S. Cl.
USPC ..... 7/138; 81/440; 59/11

(58) Field of Classification Search ..... 59/7, 8, 59/11, 35.1; 7/138; 81/440
See application file for complete search history.

(56) References Cited

U.S. PATENT DOCUMENTS

| | | | | |
|---|---|---|---|---|
| 4,103,378 | A | 8/1978 | Granados | |
| 4,967,435 | A | 11/1990 | Seals | |
| 5,303,439 | A | 4/1994 | Seals | |
| 6,988,288 | B2 * | 1/2006 | Wang | 7/138 |
| 7,140,280 | B2 * | 11/2006 | Hawkins et al. | 81/440 |
| 7,281,456 | B2 * | 10/2007 | Chiang | 81/440 |
| 7,299,514 | B2 * | 11/2007 | Wu | 7/138 |
| 8,166,744 | B2 * | 5/2012 | Valle et al. | 59/7 |

* cited by examiner

*Primary Examiner* — David B Jones
(74) *Attorney, Agent, or Firm* — Charles E. Baxley

(57) ABSTRACT

A chain link remover includes a seat having an opening formed between an anvil and a block for receiving a chain, the block includes a screw hole for engaging with a threaded shaft which includes a link ejector rod for engaging with a chain link pin of the chain and for removing the chain link pin from the chain, and a positioner is extended from one plate of a housing and located above the anvil for engaging with the chain and for stably retaining the chain in the opening of the seat. Two hooks are pivotally attached to the housing for engaging with the chain and for stably anchoring the chain to the housing.

13 Claims, 7 Drawing Sheets

CHAIN LINK REMOVER FOR BICYCLE

BACKGROUND OF THE INVENTION

1. Field of the Invention

The present invention relates to a chain link remover or bicycle tool kit, and more particularly to a chain link remover including a chain support or seat for stably engaging with and for solidly supporting the chain and for allowing the chain link pin to be easily removed or disengaged from the chain, and for allowing the chains of different widths or dimensions to be easily actuated or operated with the chain link remover.

2. Description of the Prior Art

Various kinds of typical chain link removers for bicycles have been developed and provided for removing chain link pins from chains, and comprise an anvil to anchor or position the chain, and a threaded shaft to engage with the chain link pins, and to remove the chain link pins from the chains.

For example, U.S. Pat. No. 4,103,378 to Granados, U.S. Pat. No. 4,967,435 to Seals, and U.S. Pat. No. 5,303,439 to Seals disclose three of the typical chain link removers for bicycles, and each comprise an anvil to anchor or position the chain, and a threaded shaft to engage with the chain link pins, and to remove the chain link pins from the chains. For removing the chain link pins from the chains, the chains are required to be disposed or engaged into the typical chain link removers and are required to be disposed or engaged between the anvil and the threaded shaft, and the chain link pins is required to be suitably aligned with the threaded shaft before operations.

However, the typical chain link removers do not include any support devices to stably support and position the chain between the anvil and the threaded shaft, such that the users have to use one of their hands to hold and position the chain between the anvil and the threaded shaft, and then to use the other hand to thread or to rotate or to operate the threaded shaft relative to the chain link removers, and such that the users may not easily operate the typical chain link removers.

U.S. Pat. No. 6,988,288 to Wang discloses another typical chain link remover for bicycles and comprising a support device to stably support and position the chain between the anvil and the threaded shaft and to allow the chain link pins to be removed or disengaged from the chains without holding the chain with the hands.

However, the typical chain link removers do not include any anchoring or securing or retaining members or elements to stably anchor or secure or retain and position the chain between the anvil and the threaded shaft, and the chain also may not be stably anchored and positioned or retained between the anvil and the threaded shaft with the support device.

The present invention has arisen to mitigate and/or obviate the afore-described disadvantages of the conventional chain link pin removers for bicycles.

SUMMARY OF THE INVENTION

The primary objective of the present invention is to provide a chain link remover including a chain support or seat for stably engaging with and for solidly supporting the chains of different widths or dimensions and for allowing the chain link pin to be easily removed or disengaged from the chain, and for allowing the chains of different widths or dimensions to be easily actuated or operated with the chain link remover.

In accordance with one aspect of the invention, there is provided a chain link remover comprising a seat including an opening formed between an anvil and a block for receiving the chains of different widths or dimensions, the block including a screw hole formed therein, a threaded shaft engaged with the screw hole of the base and including a link ejector rod for engaging with a chain link pin of the chain and for selectively removing or disengaging the chain link pin from the chain, and a positioner is further provided and located above the anvil for engaging with the chain and for solidly or stably retaining the chain in the opening of the seat.

A housing may further be provided, and the positioner is extended from the housing. The housing includes two plates, and the positioner is extended from of one of the plates and extended into the opening of the seat.

The housing includes two plates, and a space formed between the plates, the seat is engaged into the space and secured to the plates. The housing includes a passage formed through the plates for engaging with the seat, and the block and the anvil are engaged in the passage of the plates.

The housing includes a partition secured or coupled between the plates. The positioner includes a reinforcing rib provided between the positioner and the housing for reinforcing the positioner. The housing includes two hooks pivotally attached to the housing for engaging with the chain and for stably anchoring the chain to the housing.

The housing includes two rods, the hooks are pivotally attached to the housing with the rods respectively. The housing includes two tool sets pivotally attached to the housing with the rods respectively.

The positioner includes a curved surface formed therein for suitably engaging with the chain and for solidly and stably retaining the chain in the opening of the seat, and the anvil includes a slot formed therein for receiving the chain link pin after the chain link pin is removed or disengaged from the chain by or with the threaded shaft.

A driving tool may further be provided for engaging with the threaded shaft and for rotating and driving the threaded shaft to disengage the chain link pin from the chain. The driving tool includes a non-circular engaging hole formed therein, and the threaded shaft includes a non-circular head for engaging with the engaging hole of the driving tool. The driving tool includes an opening formed therein.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
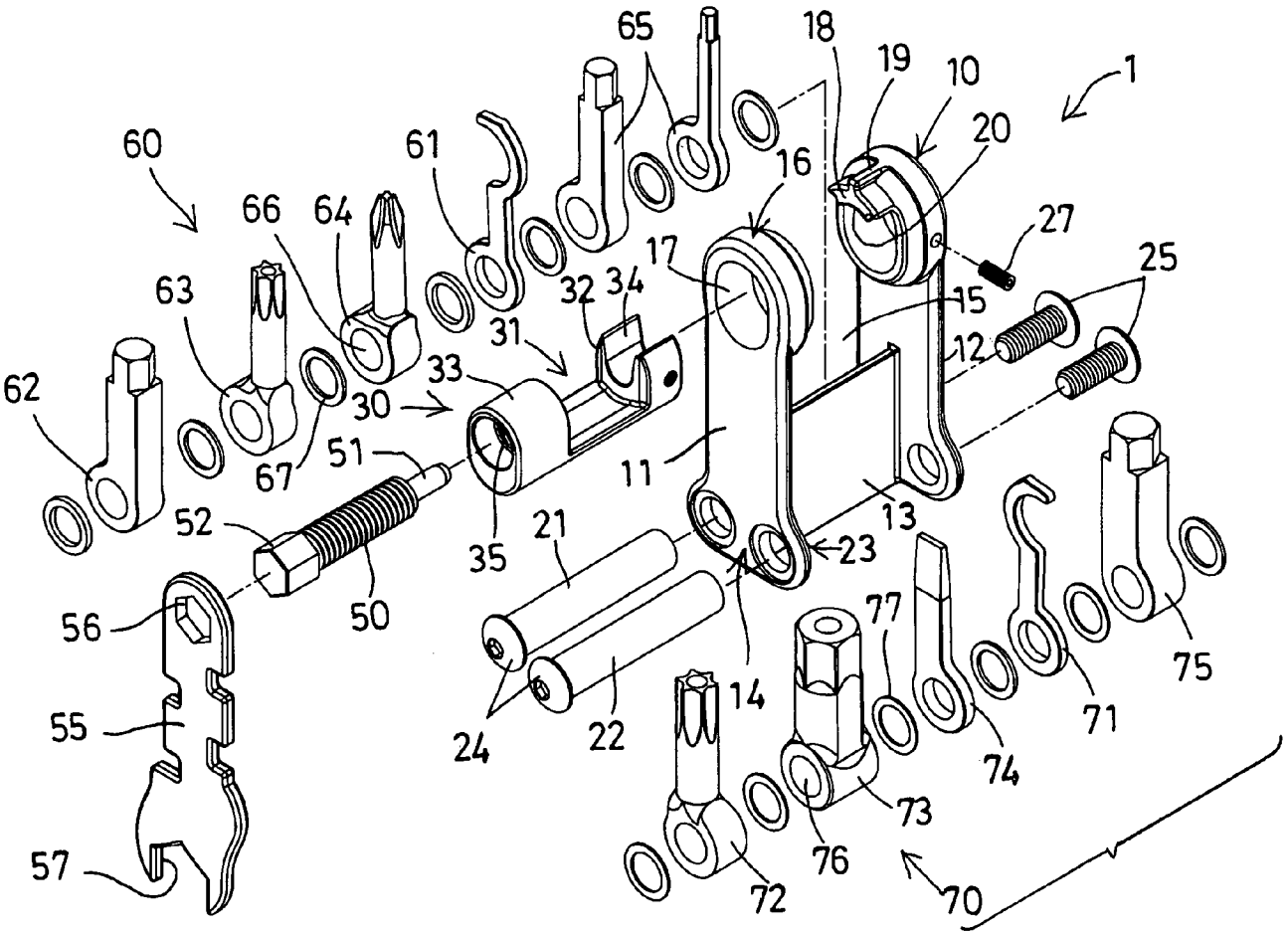
FIG. 1 is an exploded view of a chain link remover for bicycles in accordance with the present invention.
Figure 2:
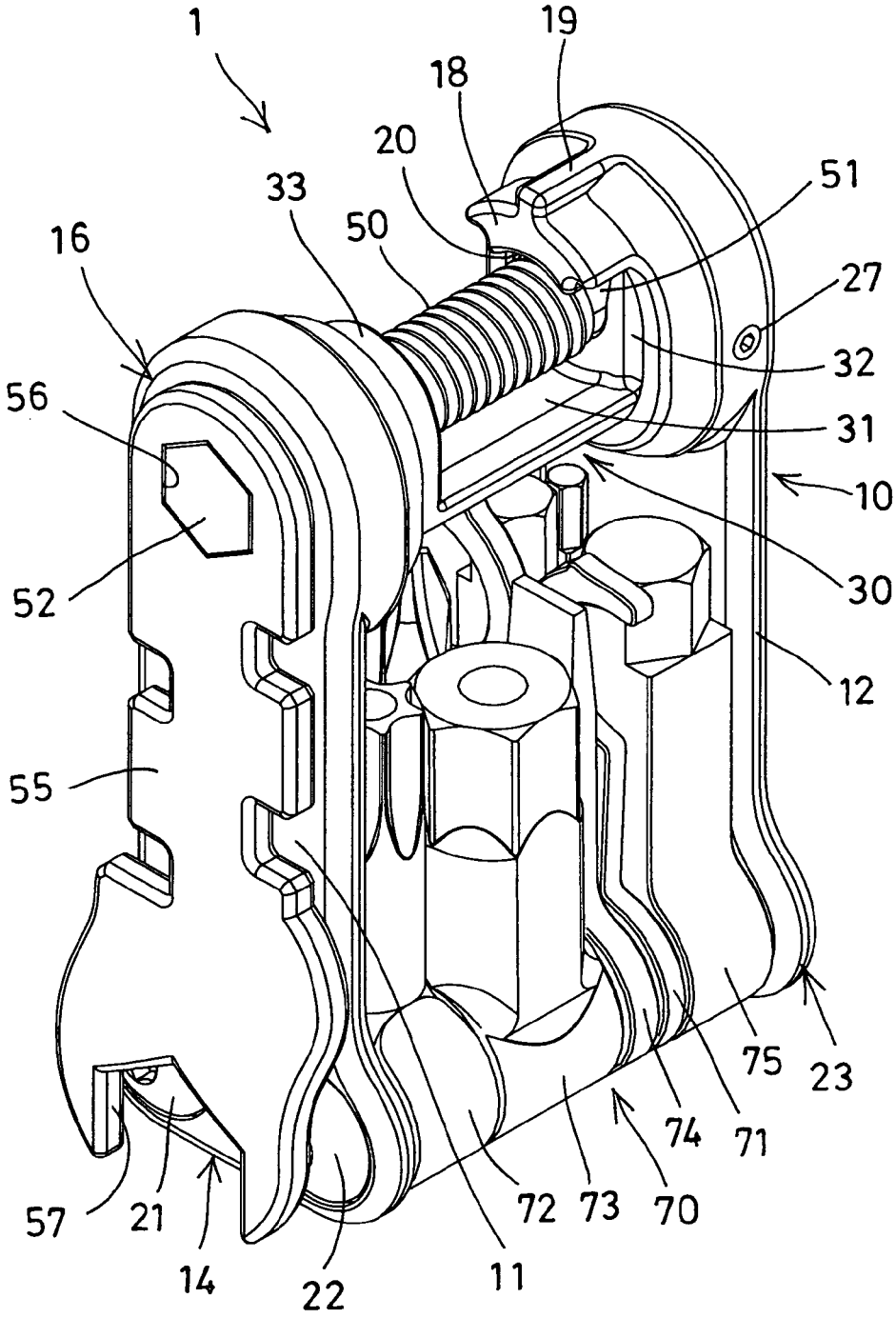
FIG. 2 is a perspective view of the chain link remover for bicycles.

Referring to the drawings, and initially to FIGS. 1 and 2, a chain link remover 1 for bicycles in accordance with the present invention comprises a base or housing 10 including a pair of opposite side walls or plates 11, 12 spaced from each other and/or faced toward each other and/or parallel to each other, and including a spacer or partition 13 disposed or attached or mounted or secured or coupled between the plates 11, 12, and particularly disposed or located between the lower portions 14 of the plates 11, 12 for forming a space 15 between the upper portions 16 of the plates 11, 12. The housing 10 further includes a channel or hole or passage 17 formed through the upper portions 16 of the plates 11, 12, and includes a retainer or positioner 18 extended from the upper portion 16 of one of the plates 12 and extended into the space 15 of the housing 10.

It is preferable, but not necessarily that the positioner 18 or the plate 12 includes a reinforcing rib 19 extended or formed or provided between the positioner 18 and the plate 12 of the housing 10 for reinforcing the positioner 18, and the positioner 18 includes a curved lower surface 20 formed therein and faced or directed toward the passage 17 of the plate 12. The housing 10 further includes one or more (such as two) rods 21, 22 disposed or attached or mounted or secured or coupled between the lower portions 14 and the side portions 23 of the plates 11, 12, and arranged to have the partition 13 disposed or located between the rods 21, 22. The rods 21, 22 each include an enlarged end or head 24 for engaging with the plates 11, 12 respectively and for solidly and stably anchoring or securing or positioning the rods 21, 22 to the plates 11, 12, and the rods 21, 22 may further be solidly and stably secured to the plates 11, 12 with fasteners 25.

Figure 3:
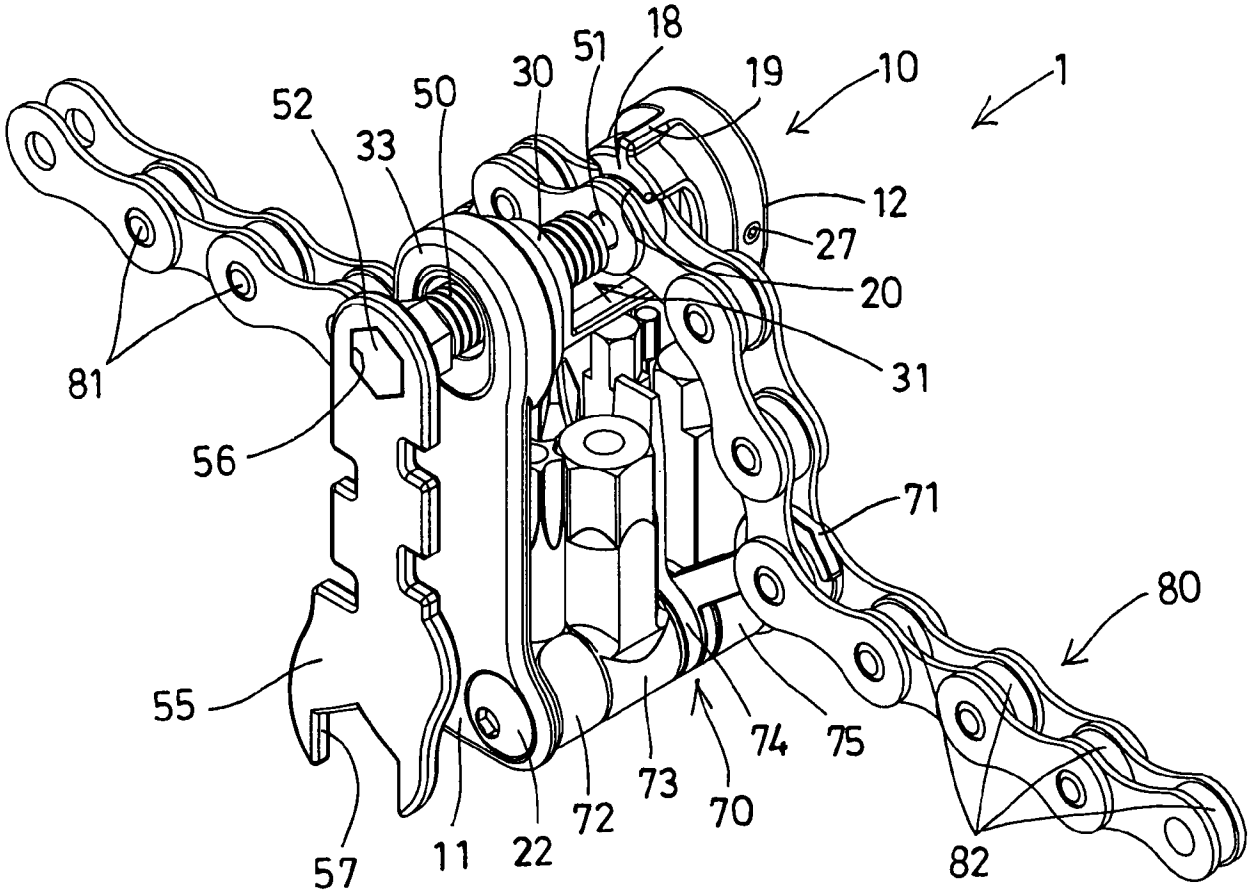
FIG. 3 is another perspective view similar to FIG. 2, illustrating the operation of the chain link remover for bicycles.
Figure 4:
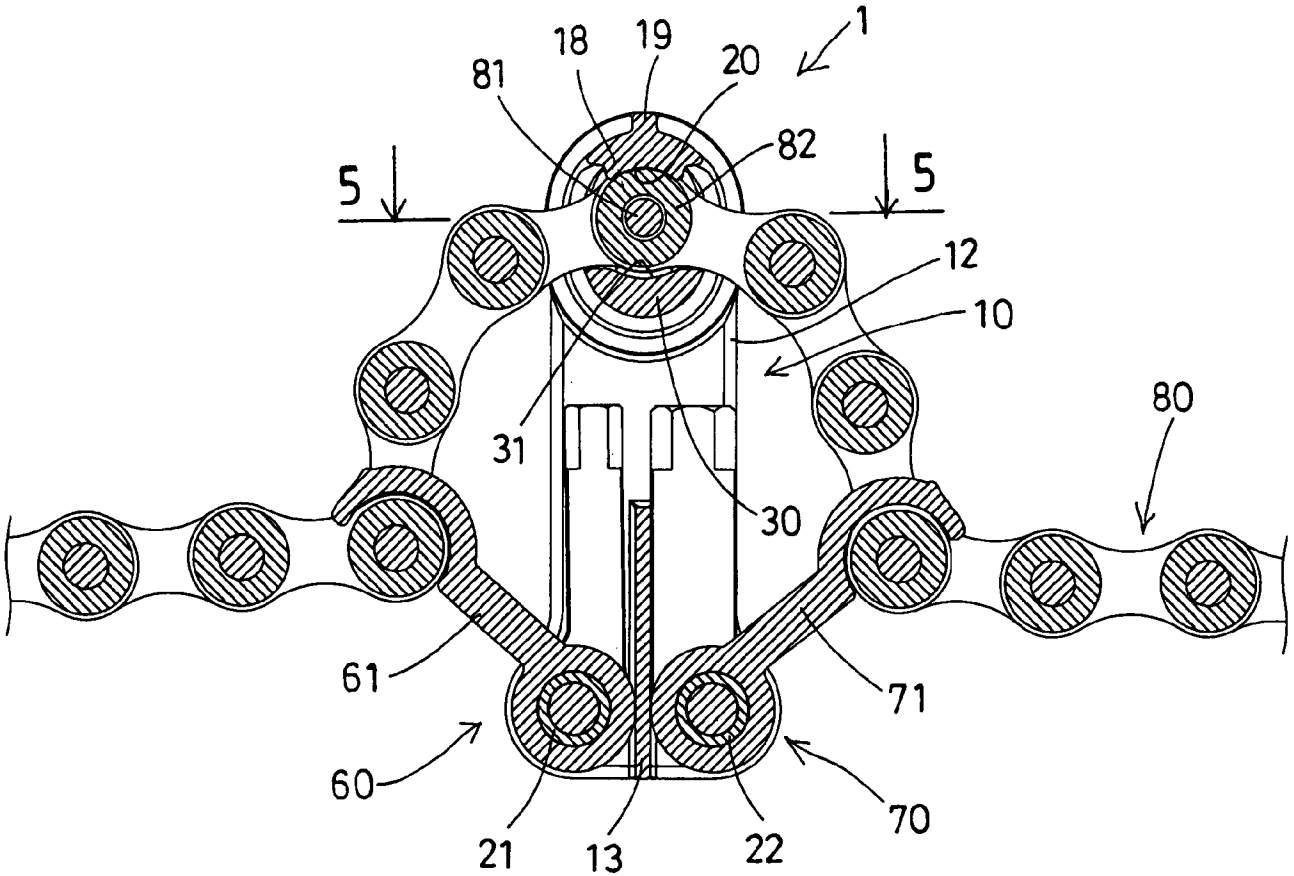
FIG. 4 is a partial cross sectional view of the chain link remover taken along lines 4-4 of FIG. 5.
Figure 5:
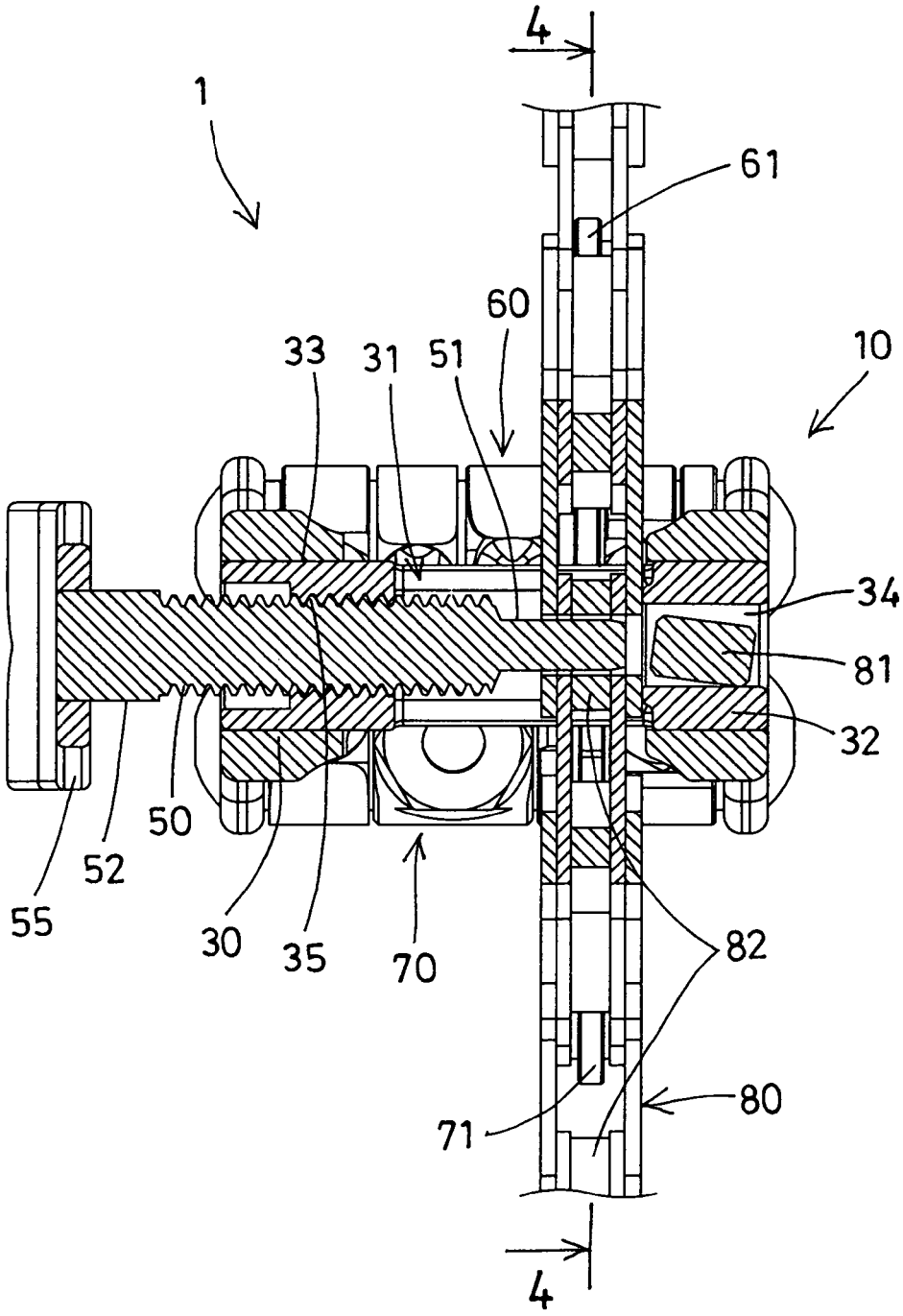
FIG. 5 is another partial cross sectional view of the chain link remover taken along lines 5-5 of FIG. 4.

A chain support or seat 30 is disposed or engaged into the space 15 or engaged through the passage 17 of the plates 11, 12 and secured to the plates 11, 12 with one or more fasteners 27, and includes an opening 31 formed in the middle portion thereof and formed or defined between an anvil 32 and a turret or block 33 for receiving or engaging with the chain 80 (FIGS. 3-5), in which the block 33 is disposed or located or engaged into the passage 17 of the plate 11, and the anvil 32 is disposed or located or engaged into the passage 17 of the other plate 12 and includes a vertical slot 34 formed therein for selectively receiving the chain link pin 81 (FIG. 5) that is removed or disengaged from the chain link 82 of the chain 80 (FIGS. 3-5). The block 33 includes a screw hole 35 formed therein and aligned with the vertical slot 34 of the anvil 32. The positioner 18 is provided or located above the anvil 32 and extended into the opening 31 of the seat 30.

A threaded shaft 50 is provided for threading or engaging with the screw hole 35 of the block 33, and includes a link ejector rod 51 formed or provided on one end thereof for selectively engaging with and for removing or disengaging the chain link pin 81 from the chain link 82 of the chain 80, and includes an enlarged and non-circular end or head 52 formed or provided on the other end thereof for selectively engaging with a driving tool 55. For example, the driving tool 55 includes a non-circular engaging hole 56 formed therein for selectively receiving or engaging with the non-circular enlarged head 52 of the threaded shaft 50 and for rotating or driving the threaded shaft 50 to selectively remove or disengage the chain link pin 81 from the chain link 82 of the chain 80, and the driving tool 55 may further include an opening 57 for engaging with and for rotating or driving the other driven tool elements or fasteners (not shown). Alternatively, the threaded shaft 50 may include a driving stud (not shown) for engaging with a corresponding socket opening (not shown) of the threaded shaft 50 and for selectively rotating or driving the threaded shaft 50.

In operation, as shown in FIGS. 3-5, the chain 80 may be disposed and supported and/or retained within the opening 31 of the seat 30 and may be solidly and stably anchored or secured or positioned to the seat 30 and/or the housing 10 with the positioner 18 that is extended from the upper portion 16 of the plate 12, and the threaded shaft 50 may then be rotated or driven by the driving tool 55 to selectively remove or disengage the chain link pin 81 from the chain link 82 of the chain 80. It is preferable that the curved lower surface 20 of the positioner 18 includes a curvature similar to that of the chain link 82 of the chain 80 for suitably and stably anchoring or securing or retaining the chain 80 to the seat 30 and/or the housing 10.

Referring again to FIGS. 1-2, the chain link remover 1 further includes one or more (such as two) tool sets 60, 70 pivotally attached or mounted or secured to the housing 10, for example, the tool sets 60, 70 each include a hook 61, 71 pivotally or rotatably attached or mounted or secured or coupled to the housing 10 with the rods 21, 22 respectively for selectively engaging with the chain 80 and for further suitably and stably anchoring or securing or retaining the chain 80 to the seat 30 and/or the housing 10 without holding or grasping by or with the hands of the users, best shown in FIGS. 3-5, and for allowing the chain link pin 81 to be solidly and stably and effectively removed or disengaged from the chain link 82 of the chain 80.

The tool sets 60, 70 each may further include one or more tool elements or tool members 62-65, 72-75 each having an orifice 66, 76 formed therein for receiving or engaging with the rods 21, 22 respectively and for pivotally or rotatably attaching or mounting or securing the hooks 61, 71 or the tool elements or tool members 62-65, 72-75 to the housing 10, and each may further include one or more gaskets or washers 67, 77 disposed or engaged between the hooks 61, 71 and/or the tool elements or tool members 62-65, 72-75 for allowing the hooks 61, 71 and/or the tool elements or tool members 62-65, 72-75 to be suitably pivoted or rotated relative to the housing 10 and the rods 21, 22. It is to be noted that the chains 80 of different widths or dimensions (not shown) may be easily and readily disposed or attached or mounted or engaged into the opening 31 of the seat 30 and may be easily actuated or operated with the chain link remover 1.

Figure 6:
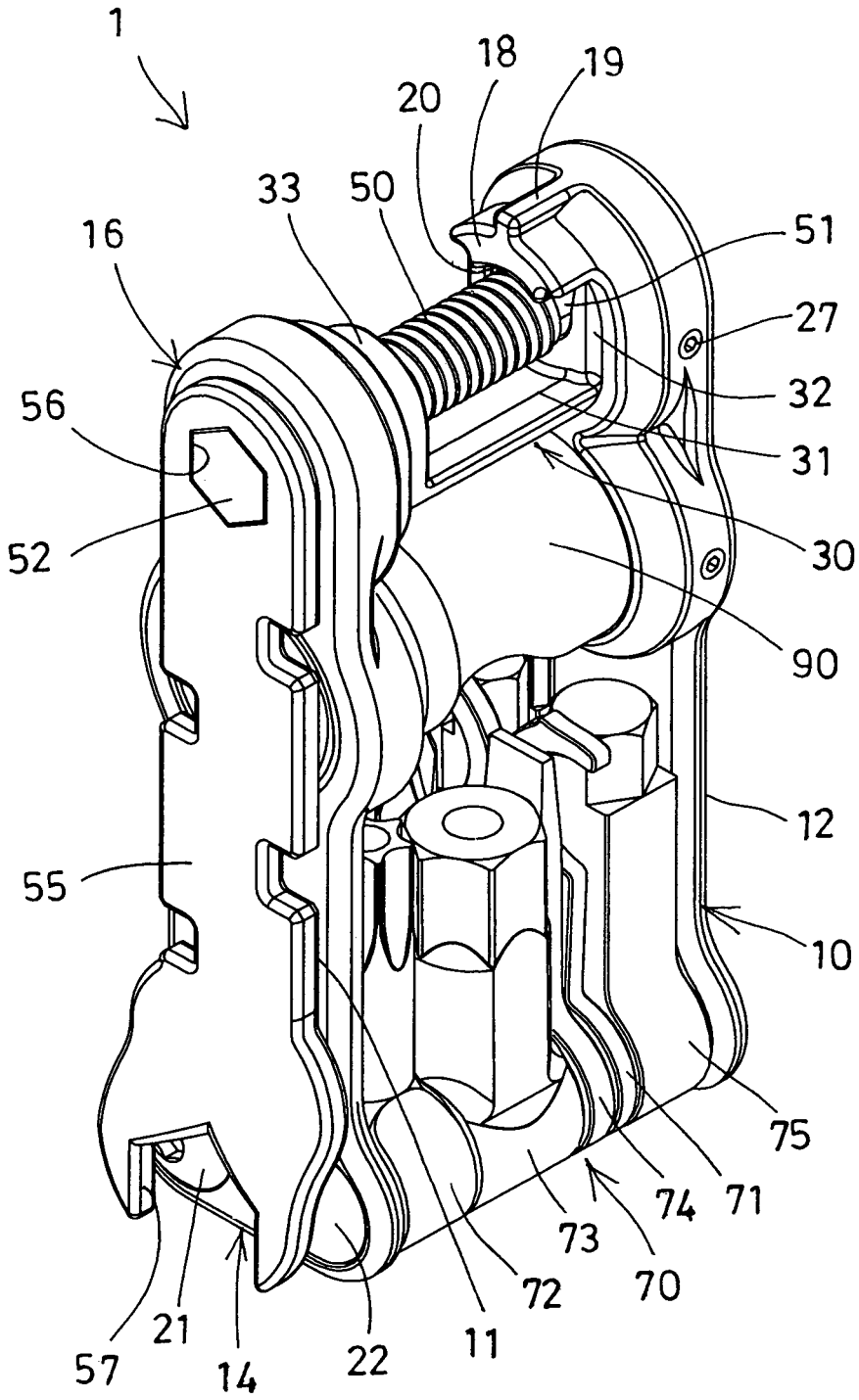
FIG. 6 is a front perspective view illustrating the other arrangement of the chain link remover.
Figure 7:
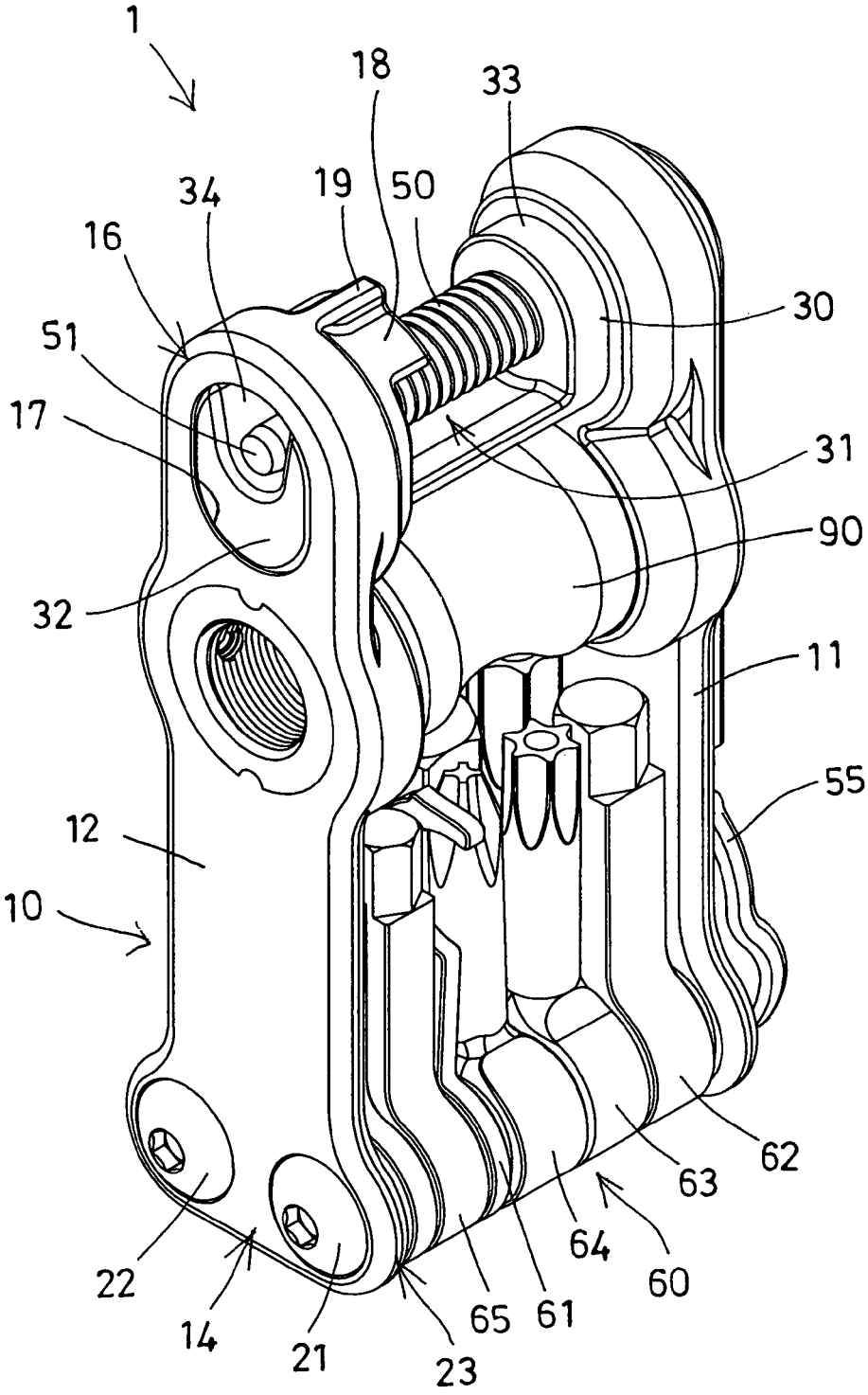
FIG. 7 is a rear perspective view of the chain link remover as shown in FIG. 6.

As shown in FIGS. 6-7, the chain link remover 1 may further include an adapter 90 disposed or attached or mounted or engaged in the space 15 that is formed between the upper portions 16 of the plates 11, 12 of the housing 10, and disposed or located between the partition 13 and the seat 30, for selectively threading or engaging with or coupling to a pressurized air bottle (not shown) which may be provided for supplying the pressurized air to fill and to inflate the tires.

Accordingly, the chain link remover for bicycles in accordance with the present invention includes a chain support or seat for stably engaging with and for solidly supporting the chain on the seat and for allowing the chain link pin to be easily removed or disengaged from the chain, and for allowing the chains of different widths or dimensions to be easily actuated or operated with the chain link remover.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A chain link remover comprising:

a housing, a seat including an opening formed between an anvil and a block for receiving a chain, said block including a screw hole formed therein, a threaded shaft engaged with said screw hole of said block, and including a link ejector rod for engaging with a chain link pin of the chain and for removing the chain link pin from the chain, and a positioner extended from said housing and provided and located above said anvil for engaging with the chain and for retaining the chain in said opening of said seat, and said positioner including a reinforcing rib provided between said positioner and said housing for reinforcing said positioner.

2. The chain link remover as claimed in claim 1, wherein said housing includes two plates, and said positioner is extended from of one of said plates and extended into said opening of said seat.

3. The chain link remover as claimed in claim 1, wherein said housing includes two plates, and a space formed between said plates, said seat is engaged into said space and secured to said plates.

4. The chain link remover as claimed in claim 3, wherein said housing includes a partition coupled between said plates.

5. The chain link remover as claimed in claim 1, wherein said positioner includes a curved surface formed therein for engaging with the chain.

6. The chain link remover as claimed in claim 1, wherein said anvil includes a slot formed therein for receiving the chain link pin of the chain.

7. The chain link remover as claimed in claim 1 further comprising a driving tool for engaging with said threaded shaft and for rotating and driving said threaded shaft to disengage the chain link pin from the chain.

8. The chain link remover as claimed in claim 7, wherein said driving tool includes an opening formed therein.

9. A chain link remover comprising:

a housing including two plates, and a space formed between said plates, a seat engaged into said space and secured to said plates, and including an opening formed between an anvil and a block for receiving a chain, said block including a screw hole formed therein, said housing including a passage formed through said plates for engaging with said seat, and said block and said anvil being engaged in said passage of said plates, a threaded shaft engaged with said screw hole of said block, and including a link ejector rod for engaging with a chain link pin of the chain and for removing the chain link pin from the chain, and a positioner extended from said housing and provided and located above said anvil for engaging with the chain and for retaining the chain in said opening of said seat.

10. A chain link remover comprising:

a housing, a seat including an opening formed between an anvil and a block for receiving a chain, said block including a screw hole formed therein, two hooks pivotally attached to said housing for engaging with the chain and for anchoring the chain to said housing, a threaded shaft engaged with said screw hole of said block, and including a link ejector rod for engaging with a chain link pin of the chain and for removing the chain link pin from the chain, and a positioner extended from said housing and provided and located above said anvil for engaging with the chain and for retaining the chain in said opening of said seat.

11. The chain link remover as claimed in claim 10, wherein said housing includes two rods, said hooks are pivotally attached to said housing with said rods respectively.

12. The chain link remover as claimed in claim 11, wherein said housing includes two tool sets pivotally attached to said housing with said rods respectively.

13. A chain link remover comprising:

a seat including an opening formed between an anvil and a block for receiving a chain, said block including a screw hole formed therein, a threaded shaft engaged with said screw hole of said block, and including a link ejector rod for engaging with a chain link pin of the chain and for removing the chain link pin from the chain, a positioner provided and located above said anvil for engaging with the chain and for retaining the chain in said opening of said seat, and a driving tool for engaging with said threaded shaft and for rotating and driving said threaded shaft to disengage the chain link pin from the chain, said driving tool including a non-circular engaging hole formed therein, and said threaded shaft including a non-circular head for engaging with said engaging hole of said driving tool.

* * * * *